US009279621B2

(12) United States Patent
Seybold et al.

(10) Patent No.: US 9,279,621 B2
(45) Date of Patent: Mar. 8, 2016

(54) INTERNAL HEAT EXCHANGER FOR A MOTOR VEHICLE AIR-CONDITIONING SYSTEM

(75) Inventors: Lothar Seybold, Nauheim (DE); Artem Seryi, Wiesbaden (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 550 days.

(21) Appl. No.: 13/206,215

(22) Filed: Aug. 9, 2011

(65) Prior Publication Data

US 2012/0036886 A1 Feb. 16, 2012

(30) Foreign Application Priority Data

Aug. 12, 2010 (DE) ..... 10 2010 034 112

(51) Int. Cl.
*F28D 7/02* (2006.01)
*F25B 40/00* (2006.01)

(52) U.S. Cl.
CPC ..... *F28D 7/024* (2013.01); *F25B 40/00* (2013.01); *F28F 2210/02* (2013.01)

(58) Field of Classification Search
CPC ..... F28D 7/022; F28D 7/02; F28D 7/024
USPC ..... 62/113, 513; 165/177
See application file for complete search history.

(56) References Cited

U.S. PATENT DOCUMENTS 1,399,479 A 12/1921 Harvey
1,738,953 A * 12/1929 Jensen ..... 165/74
1,768,222 A * 6/1930 Uhde ..... 165/163
1,994,934 A * 3/1935 Wagenseller ..... 165/156
2,061,742 A 11/1936 Swart
2,223,900 A 12/1940 Pownall
2,456,775 A 11/1944 Fausek et al.
2,482,171 A 9/1949 Ernest
3,070,975 A 1/1963 Cornelius
3,245,395 A 4/1966 Golibrzuch
3,747,632 A 7/1973 Kok et al.
4,167,969 A 9/1979 Ritzenthaler
4,203,392 A 5/1980 McLane
4,286,653 A 9/1981 Edwards
5,097,898 A 3/1992 Verkaart (Continued)

FOREIGN PATENT DOCUMENTS

CH 321638 A 5/1957
CN 1457302 A 11/2003

(Continued)

OTHER PUBLICATIONS

Chinese Office Action dated Aug. 28, 2014 in CN 201110348498.7.

(Continued)

*Primary Examiner* — Ljiljana Ciric
*Assistant Examiner* — Alexis Cox
(74) *Attorney, Agent, or Firm* — Ingrassia Fisher & Lorenz PC

(57) ABSTRACT

A heat exchanger for a motor vehicle air-conditioning system includes: an outer tube, and an inner tube. The outer tube has a first path inlet and a first path outlet through which a first fluid is permitted to flow. The inner tube is disposed within the outer tube and has a second path inlet and a second path outlet through which a second fluid is permitted to flow. The inner tube branches off in a first region into at least two heat exchanger tubes.

10 Claims, 1 Drawing Sheet

(56) References Cited

U.S. PATENT DOCUMENTS

| | | | | |
|---|---|---|---|---|
| 5,533,362 | A | 7/1996 | Cook et al. | |
| 6,484,268 | B2 | 11/2002 | Tamura et al. | |
| H2139 | H | 1/2006 | Moore | |
| 7,866,378 | B2 | 1/2011 | Nakamura et al. | |
| 2002/0046830 | A1 | 4/2002 | Ulrich et al. | |
| 2002/0074111 | A1 | 6/2002 | Seeger et al. | |
| 2002/0157815 | A1 | 10/2002 | Sutter | |
| 2004/0107727 | A1 | 6/2004 | Kim et al. | |
| 2004/0261450 | A1 | 12/2004 | Yoshino et al. | |
| 2005/0103482 | A1 | 5/2005 | Park et al. | |
| 2006/0096744 | A1 | 5/2006 | Nakamura et al. | |
| 2009/0025814 | A1 | 1/2009 | Olsson | |
| 2010/0018246 | A1 | 1/2010 | Wolfe et al. | |
| 2010/0181045 | A1 | 7/2010 | Bognarne Fejes | |
| 2012/0055195 | A1 | 3/2012 | Wolfe et al. | |
| 2012/0097380 | A1* | 4/2012 | Hilgert et al. | 165/177 |
| 2012/0174605 | A1 | 7/2012 | Huff et al. | |
| 2012/0279690 | A1 | 11/2012 | Seybold et al. | |
| 2013/0139541 | A1* | 6/2013 | Seybold et al. | 62/498 |
| 2015/0159957 | A1 | 6/2015 | Baxi et al. | |

FOREIGN PATENT DOCUMENTS

| | | | |
|---|---|---|---|
| DE | 3132641 | A1 | 6/1982 |
| DE | 3510049 | A1 | 10/1986 |
| DE | 3803439 | A1 | 8/1989 |
| DE | 69108795 | T2 | 11/1995 |
| DE | 29607467 | U1 | 8/1996 |
| DE | 102005052972 | A | 6/2006 |
| DE | 102005052972 | A1 | 6/2006 |
| DE | 102009043712 | A1 | 4/2011 |
| DE | 102012017405 | A1 | 3/2014 |
| EP | 0108525 | A1 | 5/1984 |
| EP | 0770845 | A2 | 5/1997 |
| EP | 1279911 | A1 | 1/2003 |
| EP | 1717528 | A2 | 11/2006 |
| FR | 547876 | A | 12/1928 |
| FR | 2667932 | A1 | 4/1992 |
| GB | 838070 | A | 6/1960 |
| GB | 1323943 | A | 7/1973 |
| JP | H01126489 | A | 5/1989 |
| JP | 2003156294 | A | 5/2003 |
| JP | 2003343995 | A | 12/2003 |
| JP | 2005061771 | A | 3/2005 |
| JP | 2010038429 | A | 2/2010 |
| JP | 2011127823 | A | 6/2011 |
| WO | 2004046601 | A1 | 6/2004 |
| WO | 2007079761 | A1 | 7/2007 |
| WO | 2007110074 | A1 | 10/2007 |
| WO | 2011038105 | A2 | 3/2011 |

OTHER PUBLICATIONS

Search Report dated Jun. 10, 2011 for DE 10 2010 034 112.6.

United States Patent Office, United States Office Action for U.S. Appl. No. 13/679,601, dated Dec. 30, 2015.

* cited by examiner

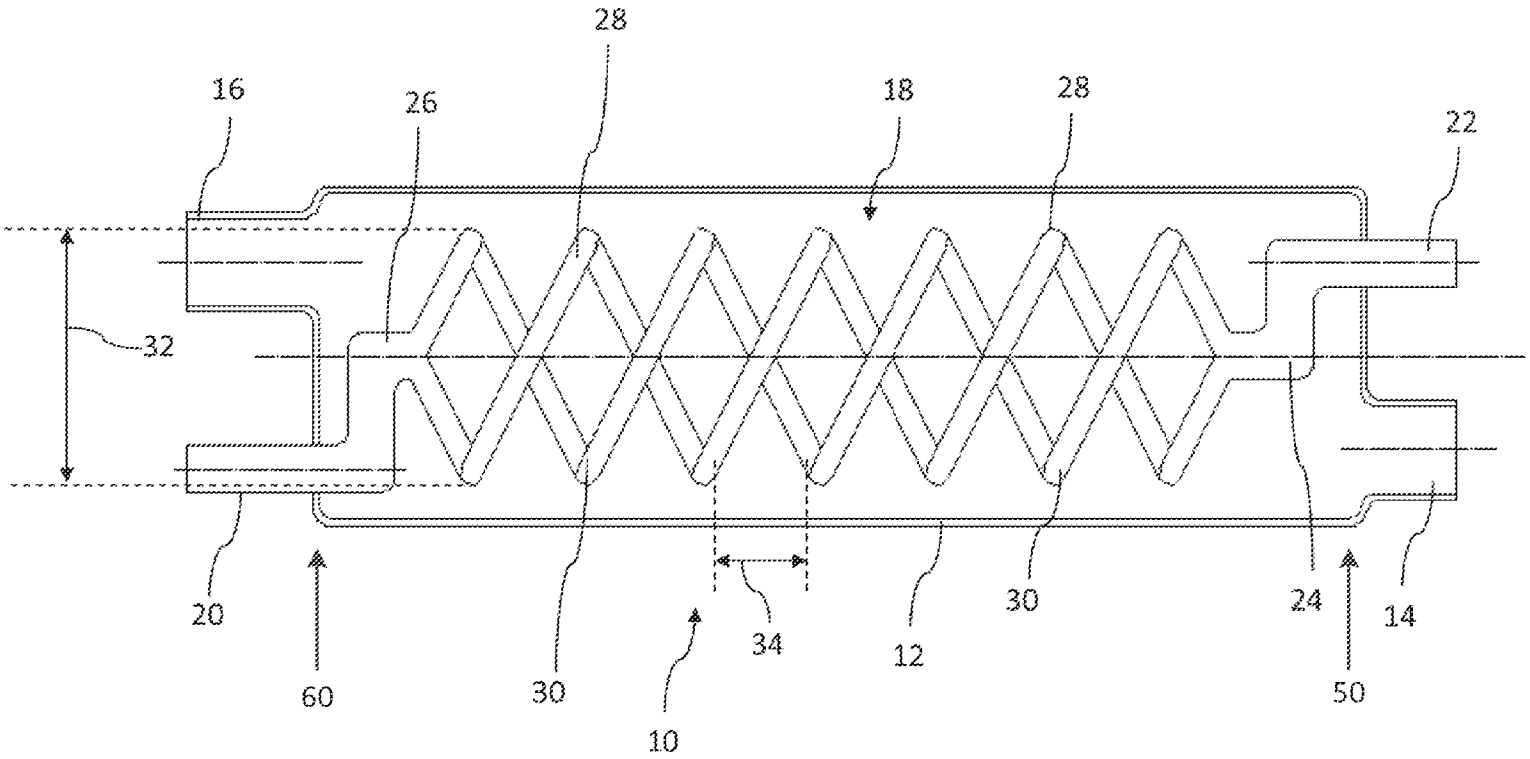
22
14
50
24
28
30
18
12
34
10
28
30
26
60
16
20
32

INTERNAL HEAT EXCHANGER FOR A MOTOR VEHICLE AIR-CONDITIONING SYSTEM

CROSS-REFERENCE TO RELATED APPLICATION

This application claims priority to German Patent Application No. 102010034112.6, filed Aug. 12, 2010, which is incorporated herein by reference in its entirety.

TECHNICAL FIELD

The technical field relates to a heat exchanger or heat transfer unit for a motor vehicle air-conditioning system, which is specifically designed in order to exchange thermal energy within a refrigerant circuit.

BACKGROUND

To increase the output and efficiency of motor vehicle air-conditioning systems, air-conditioning system-internal heat exchangers, so-called internal heat exchangers (IHX) are known, which thermally couple a section of the refrigerant circuit running between evaporator and compressor with a section of the refrigerant circuit running between condenser and expansion valve. In this manner the relatively cold refrigerant flowing from the evaporator to the compressor can be utilized for (pre-) cooling or sub-cooling of the comparatively warm refrigerant fed to the expansion device on the high-pressure side of the refrigerant circuit.

Thus, DE 10 2005 052 972 A1 for example describes a double-walled heat exchanger tube with an outer tube and an inner tube defining a channel between them. Here, the high-pressure refrigerant flows through the channel and the low-pressure refrigerant flows through the inner tube.

To optimize the manner of operation of such heat exchangers in the refrigerant circuit the geometrical dimensions and designs of the tubes are of overriding importance. In an existing vehicle package, which hardly offers room for the individual adaptation or changing of the outer contour or outer geometry of the heat exchanger, it is relatively difficult to individually, such as vehicle type specifically, adapt such heat exchangers with respect to their heat exchanger capacity to predetermined requirements.

Heat exchanger configurations which are known and described for example in DE 10 2005 052 972 A1 provide for example extruded or two-part section tubes with a substantially unchanged heat exchanger area in section longitudinal direction, which in this respect, dependent on the length and the diameter of the tubes, in each case can only transfer or exchange a constant amount of heat that remains the same at all times.

Compared with this, at least one object is to provide a heat exchanger with predetermined outer dimensions and outer contours which on the one hand provides an improved degree of thermal energy transfer between high-pressure side and low-pressure side of the refrigerant circuit and which on the other hand can be adapted with respect to its heat transfer or heat exchange capacity as variably and easily as possible to predetermined thermal requirements. In addition, the heat exchanger is to be characterized by low manufacturing costs and make possible a simple as well as intuitive installation. In addition, other objects, desirable features and characteristics will become apparent from the subsequent summary and detailed description, and the appended claims, taken in conjunction with the accompanying drawings and this background.

SUMMARY

The heat exchanger is designed for a motor vehicle air-conditioning system and comprises an outer tube through which a fluid and/or a gas can flow and at least one inner tube through which a fluid and/or gas can flow. Inner tube and outer tube at least in sections form an intermediate space within the outer tube through which a flow can flow. The inner tube and the outer tube in this case can run coaxially to each other in sections, particularly when the outer tube has a substantially cylindrical shape. It is furthermore provided that the inner tube in a first region located within the outer tube branches off into at least two heat exchanger tubes.

Here, the inner tube located within the outer tube can branch off into two, three, four or several heat exchanger tubes so that in accordance with the number of heat exchanger tube branches the heat exchange area of the inner tube and its branches can be designed variably without a change of the geometry and/or contour of the outer tube being required for this.

The heat exchanger tubes branched off within the outer tube can also have a course within the outer tube corresponding to the predetermined heat exchanger output in each case, in order to be able to variably adapt the effective heat exchanger area on the inner tube side in this manner. Through a variably modifiable branching of the inner tube into several heat exchanger tubes that can be adapted to predetermined requirements the heat exchange degree of the heat exchanger can be changed by up to approximately 20% and beyond, without substantial change of the outer contour of the heat exchanger. Thus, a heat exchanger can provide different heat transfer capacities adapted to the respective requirement despite predetermined outer dimensions that always remain the same.

According to an advantageous further development it is hereby provided that the at least two heat exchanger tubes terminate within each other in a second region likewise located within the outer tube. Because of this it can be additionally achieved that the inner tube and the outer tube have to penetrate each other merely at two points, namely entering and exiting the outer tube. Another purpose of this is that both the outer but above all the inner tube each only have to be fluidically connected to an inflow and outflow upon installation in the motor vehicle or in the refrigerant circuit. For different configurations of the heat exchanger and of its inner tube an outer configuration and installation situation that is always the same can thus be provided.

According to a further preferred configuration it is additionally provided that the first and the second mouth or branching-off region of the inner tube are substantially designed symmetrically to each other. This means the branching of the inner tube into two separate heat exchange tubes is designed almost identical to the mouth or confluence of the two heat exchanger tubes corresponding thereto. In terms of manufacturing, largely identical components can be used in this respect for the branching-off as well as for the mouth region.

It is furthermore conceivable to not only design mouth and branching-off region of the inner tube but where applicable also the passage of the inner tube through the outer tube or the inflows and outflows for inner and outer tube on both sides of the heat exchanger largely identically, so that in this manner even a redundant or rotated installation possibility for the heat exchanger can be created.

According to a further development it is additionally provided that at least one heat exchanger tube and/or that all heat exchanger tubes of the inner tube extending between the first and second regions entirely run within the outer tube. It additionally proves to be advantageous if the at least two heat exchanger tubes of the inner tube at least in sections substantially run parallel to each other.

According to a further preferred configuration at least one of the heat exchanger tubes is designed wound helically or spirally, i.e. twisted in a screw-like manner. In this way, depending on axial pitch and depending on diameter both of the tube as well as the helix formed thereof the surface of the inner tube-sided heat exchanger tube running within the outer tube can be variably adapted to predetermined requirements. Advantageously, the at least two or several heat exchanger tubes are arranged for forming a double or multiple helix. In this respect, a comparatively high packing density as well as a preferably large heat exchange area can be provided for the plurality of heat exchanger tubes.

According to a further configuration it has been proved advantageous if the outer diameter of the helically or spirally wound heat exchanger tubes is between the approximately 0.5-fold and the approximately 0.8-fold of the inner diameter of the outer tube. Alternatively or additionally to this it can be provided that the inner diameter of the branched-off heat exchanger tubes of the inner tube amounts to less than approximately 1 cm, preferentially less than approximately 5 mm, most preferentially between approximately 1.5 mm and approximately 4 mm. Independently of this or in addition to this the axial spacing of two adjacent windings of the heat exchanger tubes can be between approximately 5 mm and approximately 30 mm, preferentially between approximately 10 mm and approximately 25 mm. Those geometrical dimensions and proportions of inner tube, inner tube course and outer tube exemplarily constitute one of many possible configurations of the heat exchanger, where applicable, also deviating from these.

According to a further configuration it can also be provided that the outer tube comprises a substantially cylindrical geometry and the heat exchanger tubes branched within themselves and running within the outer tube come to lie with their helical axis in a manner that is parallel and/or overlapping to the cylinder longitudinal axis of the outer tube. In this respect, a radially centered arrangement of heat exchanger tubes located inside and the outer tube is provided.

In further preferred configuration the outer tube is designed as low-pressure line and the inner tube and/or its branched-off heat exchanger tubes are provided as high-pressure lines. Consequently the inner tube and its heat exchanger tubes branched-off within themselves are predominantly subjected to a compressed fluid through-flow while the outer tube or the intermediate space formed between outer tube and the heat exchanger tubes is subjected to a predominantly gaseous refrigerant through flow. As a modification of this it can be additionally provided to design the outer tube as high-pressure line and the inner tube as low-pressure line and accordingly fluidically connect said outer tube to the components of the refrigerant circuit.

It is additionally provided for the heat exchanger largely having a tubular and cylindrical outer contour that end sections of the outer tube located opposite each other can be arranged downstream of an evaporator and upstream of a compressor in the refrigerant circuit of a motor vehicle air-conditioning system. Accordingly, an arrangement for the end sections of the inner tube located opposite each other or the correspondingly branched-off heat exchanger tubes is provided upstream of an expansion device and downstream of a condenser in the refrigerant circuit of the air-conditioning system. It applies in general that the low-pressure line(s) is (are) designed for the fluidic coupling of evaporator and compressor, the high-pressure line(s) for the fluidic coupling of condenser and expansion device of the refrigerant circuit of the air-conditioning system.

In a further independent aspect furthermore relates to a motor vehicle air-conditioning system having a refrigerant circuit with at least one compressor, a condenser, an expansion device and an evaporator, which are serially in fluidic connection with one another by means of suitable lines of the refrigerant circuit and are fluidically coupled to one another for circulating the refrigerant. The refrigerant circuit in this case additionally comprises a previously described heat exchanger preferably of a tubular design, which brings about a heat exchange between the side located downstream of the evaporator and the high-pressure side of the refrigerant circuit located upstream of the expansion device.

In a further independent aspect furthermore relates to a motor vehicle having an air-conditioning system or at least one previously described heat exchanger configured in such a manner.

BRIEF DESCRIPTION OF THE DRAWINGS

The present invention will hereinafter be described in conjunction with the following drawing FIG. 1, which shows a tubular heat exchanger with a branched-off inner tube in cross section.

DETAILED DESCRIPTION

The following detailed description is merely exemplary in nature and is not intended to limit application and uses. Furthermore, there is no intention to be bound by any theory presented in the preceding background or summary or the following detailed description.

The heat exchanger 10 shown in FIG. 1 comprises an outer tube 12 substantially designed cylindrically with a first side 50 and a second side 60 and having an inflow 16 and an outflow 14 as well as an inner tube 18 with an inflow 22 and an outflow 20 Inner tube 18 and outer tube 12 are subjected to the admission in opposite direction of a refrigerant circulating in the refrigerant circuit. The inner tube 18 in the configuration shown is preferentially designed as high-pressure line and provided for cooling a compressed refrigerant flowing through the inner tube 18.

Here, the outer tube 12 or the intermediate space formed by outer tube 12 and inner tube 18 is subjected to the through-flow in opposite direction of a low-pressure refrigerant, i.e., from the inflow 16 located on the left in FIG. 1 to the outflow 14 located on the right, which is for example predominantly present in the gaseous phase.

As is shown in FIG. 1, the inner tube 18 branches off downstream of its inflow 22 in a branching-off section 24 into two heat exchanger tubes 28, 30 wound spirally or helically which are arranged to each other in the manner of a double helix. Facing the axial end of the outer tube 12 located opposite, the heat exchanger tubes 28, 30 again lead into a single inner tube section in the mouth region 26, which leads to the outflow 20 of the inner tube 18.

Here, the inner tube 18 penetrates the axial phase ends of the outer tube 12, which is the phase ends located left and right, each with its inflow 22 and its outflow 20. In the shown embodiment, the respective inflows and outflows 22, 16, 20, 14 of inner tube 18 and outer tube 12 located opposite are arranged substantially parallel and radially offset to the center axis of the heat exchanger which is substantially of a cylindrical or tubular design.

Deviating from this it is likewise conceivable that the inflow 22 or the outflow 20 of the inner tube 18 also penetrates the cylinder wall of the outer tube 12 of the heat exchanger 10 located radially outside. It is additionally conceivable that the inner tube is also designed as low-pressure line and the outer tube as high-pressure line, wherein with such a configuration the geometrical conditions with respect to tube diameter and helix diameter as well as pitch of the helix of the inner tube 18 require a suitable coordination.

Preferably the outer diameter 32 of the helically or spirally wound heat exchanger tubes 28, 30 located inside is between the approximately 0.5-fold and the approximately 0.8-fold of the inner diameter of the outer tube 12.

It proves to be additionally advantageous for optimizing the heat exchange degree if the clear axial spacing 34 of two adjacent windings of the heat exchanger tubes 28, 30 is between approximately 5 mm and approximately 30 mm, preferably between approximately 10 mm and approximately 25 mm. Here, greater axial spacings are likewise conceivable. On the whole, the design of a coaxial tube heat exchanger shown here allows relatively much space with respect to a varying exchange degree with outer dimensions of the heat exchanger 10 remaining the same.

Thus, the degree of the heat exchange can be adapted universally and independently of the installation space requirements to different as well as varying heat exchange capacities dependent on vehicle and/or air-conditioning system. Thus, a heat exchanger with two spirally wound heat exchanger tubes could be substituted for example with a heat exchanger having three or several heat exchanger tubes of comparable or different configuration.

The shown embodiments merely show a possible configuration with regard to which further numerous versions are conceivable and are within the scope. The exemplarily shown exemplary embodiments must in no way be interpreted as being restrictive in terms of the scope, the applicability or the configuration possibilities. The present description merely shows the person skilled in the art a possible implementation of an exemplary embodiment. Thus, a wide range of modifications can be carried out on the function and arrangement of described elements without leaving the scope of protection or its equivalence defined by the following claims by doing so.

Moreover, while at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

The invention claimed is:

1. heat exchanger for a motor vehicle air-conditioning system, comprising:

an outer tube including:

a side wall having an axis of symmetry defining a longitudinal axis;

a first end wall enclosing a first end of the side wall;

a second end wall enclosing a second end of the side wall opposite the first end wall;

wherein the first and second end walls are substantially perpendicular to the longitudinal axis;

a first inlet radially offset from the longitudinal axis and formed through the first end wall, the first inlet corresponding to a first path through which a first fluid is permitted to flow;

a first outlet radially offset from the longitudinal axis and formed through the second end wall, the first outlet corresponding to the first path, wherein the first outlet is arranged diagonally opposite from the first inlet and;

a second inlet formed through the second wall, the second inlet corresponding to a second path through which a second fluid is permitted to flow;

a second outlet formed through the first end wall, the second outlet corresponding to the second path, wherein the second outlet is arranged diagonally opposite from the second inlet; and an inner tube disposed within the outer tube that corresponds to the first path, the inner tube including an inlet branching section extending from the first inlet in a first region of the inner tube and branching into at least two heat exchanger tubes, which are spirally wound to form a double helix, arranged in spaced relation to define a columnar gap therebetween, and in fluid communication with the first outlet.

2. The heat exchanger according to claim 1, wherein the at least two heat exchanger tubes are configured to re-join each other at an outlet branching section in a second region of the inner tube.

3. The heat exchanger according to claim 1, wherein the first inlet and the second outlet of the inner tube are symmetrical to each other.

4. The heat exchanger according to claim 1, wherein the at least two heat exchanger tubes are configured to run parallel to each other.

5. The heat exchanger according to claims 1, wherein an outer diameter of the double helix is between 0.5-fold and 0.8-fold of an inner diameter of the outer tube.

6. The heat exchanger according to claim 1, wherein an inner diameter of the at least two heat exchanger tubes is in a range between 1.5 mm and 4 mm.

7. The heat exchanger according to claim 1, wherein an axial spacing of two adjacent windings of the at least two heat exchanger tubes is between 10 mm and 25 mm.

8. The heat exchanger according to claim 1, wherein the outer tube comprises a cylindrical geometry and the at least two heat exchanger tubes have a helical axis that overlaps a cylinder longitudinal axis of the outer tube.

9. The heat exchanger according to claim 1, wherein the first fluid has a pressure and the second fluid has a pressure higher than the pressure of the first fluid.

10. The heat exchanger according to claim 1, wherein an outer diameter of the at least two heat exchanger tubes is between 0.5-fold and 0.8-fold of an inner diameter of the outer tube.

* * * * *